United States Patent [19]

Crowell

[11] 4,068,594

[45] Jan. 17, 1978

[54] TAMPING TOOL

[76] Inventor: James E. Crowell, 708 Marlin Ave., Foster City, Calif. 94404

[21] Appl. No.: 655,078

[22] Filed: Feb. 4, 1976

[51] Int. Cl.[2] ..... E01B 27/00

[52] U.S. Cl. ..... 104/10; 37/142 A; 172/719

[58] Field of Search ..... 104/10, 11, 12, 13, 104/7 R, 7 A, 7 B, 8; 172/719; 81/52.3, 52.35; 37/141 R, 141 T, 142 R, 142 A

[56] References Cited

U.S. PATENT DOCUMENTS

| | | | |
|---|---|---|---|
| 163,835 | 5/1875 | Wimpee | 104/13 |
| 3,082,555 | 3/1963 | Hill | 172/719 |
| 3,465,833 | 9/1969 | Lutz | 172/719 |
| 3,469,331 | 9/1969 | Wood | 172/719 |
| 3,536,147 | 10/1970 | Norton | 172/719 |
| 3,581,664 | 6/1971 | Kruse et al. | 104/12 |
| 3,638,736 | 2/1972 | Hahn | 172/719 |

FOREIGN PATENT DOCUMENTS

| | | | |
|---|---|---|---|
| 489,603 | 1/1930 | Germany | 172/719 |
| 494,322 | 1/1937 | United Kingdom | 37/141 |

*Primary Examiner*—Robert J. Spar
*Assistant Examiner*—Carl Rowold
*Attorney, Agent, or Firm*—Gregg, Hendricson, Caplan & Rosso

[57] ABSTRACT

Tamping tool for tamping railroad ballast comprising shank and detachable foot member. In one form, there is a detachable wedge inserted between the upper portion of the foot member and the shank. In another form, there is an arcuate joint between the foot member and the shank.

1 Claim, 9 Drawing Figures

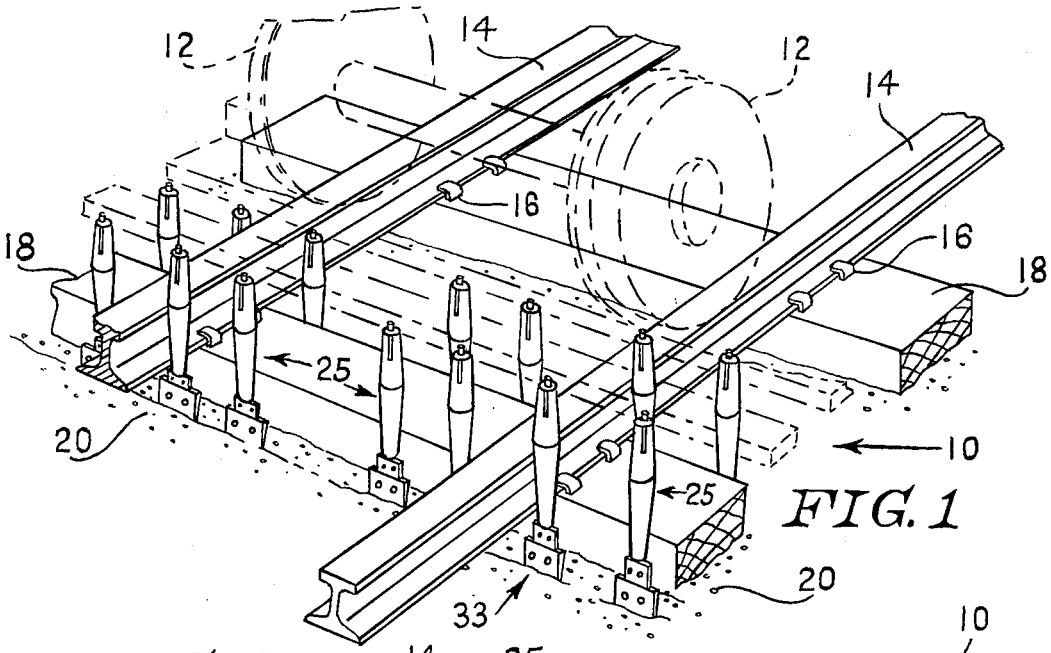
FIG. 1
FIG. 2
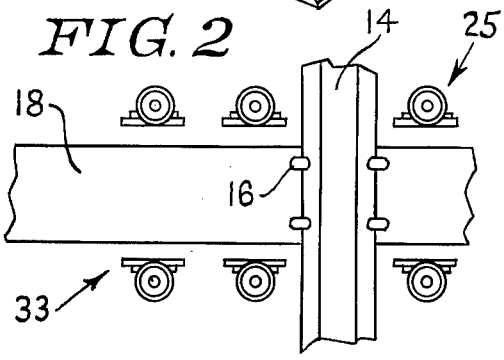
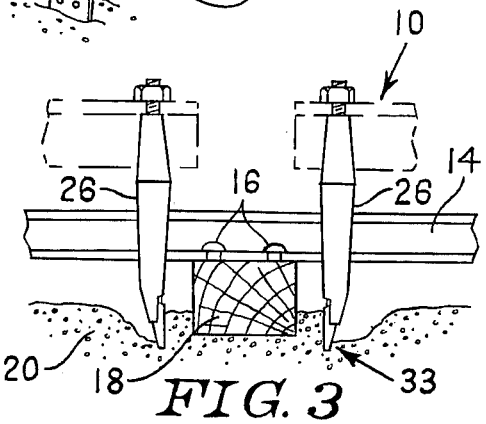
FIG. 3
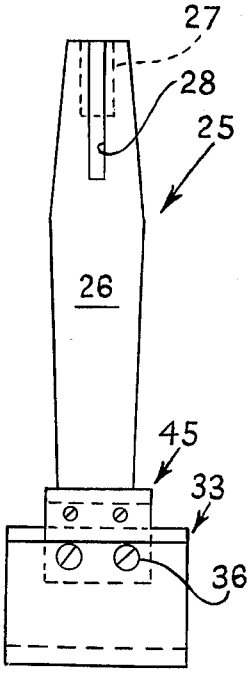
FIG. 4
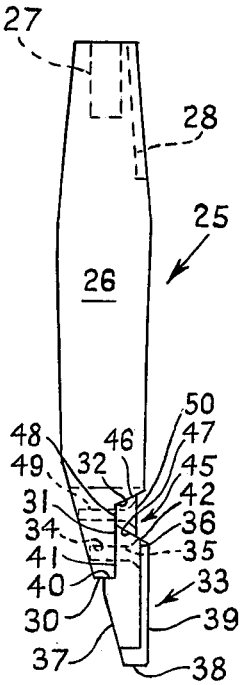
FIG. 5
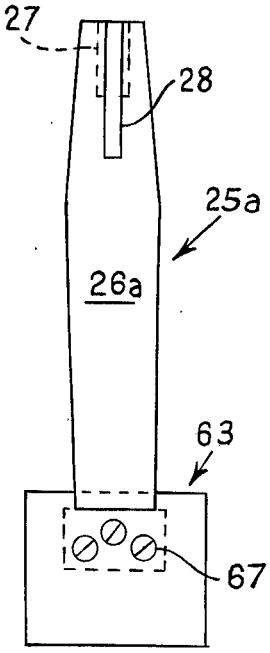
FIG. 6
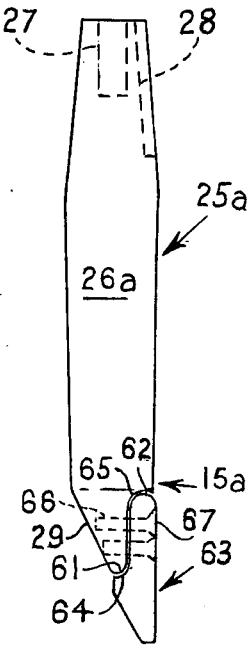
FIG. 7

TAMPING TOOL

This invention relates to a tamping tool for tamping ballast, particularly ballast on a railroad bed.

In Kruse and Crowell U.S. Pat. No. 3,581,664, there is described and claimed a tamping tool for tamping railroad ballast which comprises a shank and a detachable foot member made of hardened steel and which makes the actual contact with the ballast.

It is the object of the present invention to provide certain improvements upon the tamping bar of the aforesaid patent.

Certain embodiments of the invention are shown by way of example in the accompanying drawing in which:

FIG. 1 is a perspective, fragmentary view showing a section of a railway with a carriage mounted thereon and with tamping tools of the present invention mounted on and carried by the carriage.

FIG. 2 is a fragmentary top plan view showing a single rail, a single tie and the disposition of the tamping tools of the present invention on opposite sides of the tie.

FIG. 3 is a view inside elevation showing two of the tamping tools of the present invention in operation.

FIG. 4 is a view in front elevation of the preferred tamping tool of the present invention.

FIG. 5 is a view in side elevation of the tool of FIG. 4.

FIGS. 6 and 7 are view similar to FIGS. 4 and 5, respectively, but showing another embodiment of the present invention.

Figure 8:
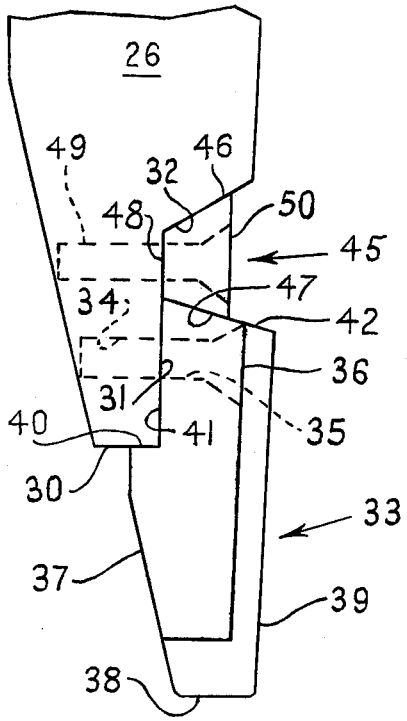
FIGS. 8 and 9 are views similar to FIGS. 5 and 7, respectively, but on a larger scale and showing only the lower portion of the tool.
Figure 9:
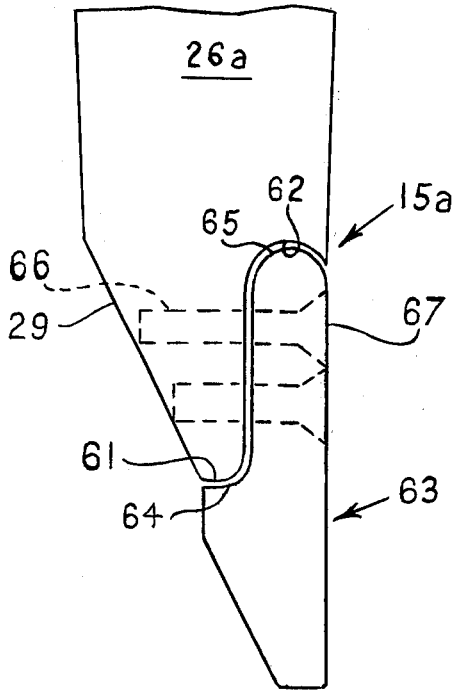

Referring now first to FIG. 1, there is shown in fragmentary broken line view a tamping machine 10 mounted on flanged wheels 12 for travel along rails 14. The rails 14 are attached by spikes 16 to cross ties 18. Cleats (not shown) may also be used. The cross ties rest upon ballast 20 which generally consists of gravel, crushed rock or the like and which is firmly packed by the tamping machine 10.

Details of the construction of the carriage 10 including the necessary equipment for moving it along the rails and for reciprocating the tamping tools may be conventional; they are well-known in the art; and they require no further description herein.

Referring now to FIGS. 4 and 5, the preferred tamping tool of the present invention is there shown and is generally designated by the reference numeral 25. It comprises a shank 26 which is tapped at its upper hand to form a threaded hole 27 to receive a stud carried by the carriage 10 for holding the tool in place on a reciprocating member it is also provided with a slot or key way 28 which receives a key (not shown) on the carriage to locate and orient the tamping tool properly, all as known in the prior art.

At its lower end and rear, the shank is tapered at 29 and it terminates in a horizontal tip 30 which, as will be seen, is inset with respect to the rear surface of the major portion of the shank 26. The shank 25 also has a vertical, inset front surface 31 terminating at its upper end in an upwardly and forwardly slanting surface 32 overlying the inset portion.

The lower end of the shank 25 is fitted with a detachable foot member 33 and mating portions of the shank and foot member are provided with mating threaded holes 34 and 35 to receive screws 36. Three such screws and corresponding threaded holes are shown and are preferred but a greater or lesser number may be used.

The foot member 33 is tapered at its rear at 37 and terminates in a horizontal tip 38; it has a flat vertical front face 39, a shoulder 40 underlying a recessed portion bounded on its inner side by a vertical surface 41 and it terminates at its upper end in an inwardly and upwardly slanting top surface 42 which together with surface 32 on shank 25 forms a wedge shaped cavity.

A wedge insert 45 is provided which fits snugly in the cavity formed by surfaces 32 and 42, such wedge having inwardly converging top and bottom surfaces 46 and 47 and an inner face 48. Mating holes 49 and 50 in the shank 25 and wedge insert 45 receive screws 50. Two such screws are shown and are preferred but a greater or lesser number may be employed.

As in the case of the tamping tool of the aforesaid Kruse and Crowell patent, the foot member or paddle 33 may be of hardened steel construction and when it is unduly worn it may be removed and replaced or if worn but still repairable, it may be removed, repaired and then replaced. And as in the tool of the aforesaid Kruse and Crowell patent, the shoulder 40 bearing against the tip 30 of the shank 25 transmits a portion of the force of tamping to the shank. However, instead of having the uppermost surface of the foot member bearing directly against the shank, in the embodiment shown in FIGS. 4 and 5, the uppermost part 42 of the foot member 33 bears against the wedge insert 45 and through that member to the shank. By tightening screws 50, the wedge insert 45 is caused to bear firmly against the two sloping surfaces 32 and 42.

Among the advantages of this construction are the fact that it permits locating the foot member 33 closer to the lower end of the shank, which makes it easier to have access to the ballast. Also, the foot member can be made smaller, yet serve as well or better.

It will be apparent that the geometry of the mating surfaces 30 and 40, 31 and 41, 42 and 47, 31 and 48 and 32 and 46 may be varied. The shapes shown are preferred, and the angle formed by surfaces 32 and 42 (also by surfaces 46 and 47) may be, for example 60° but may be varied. Thus, surfaces 30 and 40 may be at a small angle to the horizontal, surfaces 31 and 41 may be at a small angle to the vertical and surfaces 42, 47 or 32, 46 may be horizontal provided one such pair of surfaces slopes to provide a wedge action. It is possible also that both pairs of surfaces 32, 46 and 42, 47 be horizontal but the wedge function is preferred and requires at least one pair, preferably two pairs, of sloping surfaces.

Referring now to FIGS. 6 and 7, a tamping tool is there shown which is generally designated as **25*a*. It comprises a shank 26*a* having, as in the case of the tamping tool of FIGS. 4 and 5, a threaded hole 27 to receive a stud and a key way 28 to receive a key. The lower portion of the shank 25 is similarly tapered at 29 but it has a curved convex tip 61 as shown and the upper end or shoulder of the recessed portion of the shank has a curved, concave configuration as shown in 62. The foot member or paddle 63 is formed with mating surfaces including a curved concave surface at 64 and a curved convex surface at 65 to conform to the mating surfaces 61 and 62 of the shank. Threaded holes 66 are provided in the shank and foot member to receive screws 67**.

Among advantages of this construction are the greater surface area between the impact transmitting surfaces 61, 64 and 62, 65. Also the nesting relationship provided by the mating concave-convex surfaces provides greater strength.

Features of the embodiment of FIGS. 6 and 7 may be combined with features of FIGS. 4 and 5. For example, the surfaces 61, 64 may be shown in FIG. 7 but a wedge insert and corresponding wedge cavity may be employed as shown in FIG. 5 and as described above in connection with FIGS. 4 and 5.

It will, therefore, be apparent that new and useful tamping tools have been provided.

I claim:

1. A tamping tool for tamping railroad ballast and the like comprising:

a. an elongated shank having a lower portion formed with a lower extremity providing a bearing surface and an inset portion extending above such bearing surface and terminating at its upper end in an outwardly sloping first shoulder overlying the recessed area;

b. a foot member having a tip at its lower end which directly bears the impact of tamping, said foot member being formed with an inwardly directed second shoulder above said tip and a recessed portion extending above and overlying said second shoulder and terminating in an outwardly sloping upper extremity;

c. said foot member being detachably clamped to the lower portion of said shank with such second shoulder abutting said bearing surface and the face of the recessed portion of said foot member abutting the face of the recessed portion of said shank;

d. the upper extremity of said foot member being spaced from said first shoulder to provide a wedge-shaped cavity between the upper extremity and the first shoulder;

e. a wedge disposed within said cavity and bearing against the upper extremity of the foot member and said first shoulder to receive and transmit to the shank the impact of tamping, and f. means detachably clamping said wedge to said shank.

* * * * *